United States Patent [19]

Edwards

[11] Patent Number: 4,748,451

[45] **Date of Patent: * May 31, 1988**

[54] ADJUSTABLE BRACKET MOUNT

[76] Inventor: Ivan J. Edwards, 1200 Holiday Pl., Bossier City, La. 71112

[ * ] Notice: The portion of the term of this patent subsequent to Jan. 21, 2003 has been disclaimed.

[21] Appl. No.: 782,024

[22] Filed: Sep. 30, 1985

Related U.S. Application Data

[63] Continuation-in-part of Ser. No. 529,484, Sep. 6, 1983, Pat. No. 4,565,346.

[51] Int. Cl.[4] ..... H01Q 1/08

[52] U.S. Cl. ..... 343/880; 343/840; 343/878; 248/274; 248/535

[58] Field of Search ..... 343/840, 878, 880, 882, 343/872; 248/558, 535, 122, 274, 282–285, 296, DIG. 3

[56] References Cited

U.S. PATENT DOCUMENTS

| | | | |
|---|---|---|---|
| 462,265 | 11/1891 | Mason | 248/274 X |
| 1,529,231 | 3/1925 | Arnold | 248/296 X |
| 3,931,624 | 1/1976 | Hundley et al. | 343/840 X |
| 4,565,346 | 1/1986 | Edwards | 248/558 |

FOREIGN PATENT DOCUMENTS

| | | | |
|---|---|---|---|
| 0221005 | 12/1984 | Japan | 343/840 |

OTHER PUBLICATIONS

Delco-Remy, "DR Instruction Sheet", DR-9134, Dec. 1, 1967.

*Primary Examiner*—Eugene R. LaRoche
*Assistant Examiner*—Seung Ham
*Attorney, Agent, or Firm*—John M. Harrison

[57] ABSTRACT

An adjustable bracket mount for mounting certain functional components such as a feed horn and a low noise amplifier feed assembly on a satellite antenna dish at the prime focus or other desired location above the antenna dish, which mount includes a base secured to the dish, a bottom support extending from the base toward the prime focus, a sloped offset bracket having one end provided in adjustable cooperation with the bottom support and the opposite end carrying a top support. The top support extends in parallel relationship to the bottom support and projects above the bottom support and a top bracket is adjustably mounted on the top support and features outwardly-extending arms designed to carry the feed assembly and mount a cover. Two variations of the top bracket are employed and a cone-shaped cover is provided to protect the feed assembly from the elements by mounting on both versions of the top bracket.

32 Claims, 1 Drawing Sheet

ADJUSTABLE BRACKET MOUNT

CROSS-REFERENCE TO RELATED APPLICATIONS

This application is a continuation-in-part of my copending patent Application Ser. No. 06/529,484, filed Sept. 6, 1983, now U.S. Pat. No. 4,565,346, issued 1/21/86.

BACKGROUND OF THE INVENTION

1. Field of the Invention

This invention relates to satellite antennas for transmitting and receiving radio and television signals to and from satellites located in a geosynchronous orbit around the earth. More particularly, the invention relates to an adjustable bracket mount for securely, accurately and removably positioning the feed horn and low noise amplifier, or the feed assembly components of the satellite antenna at the prime focus, or the point toward which the satellite dish reflects and concentrates the signals, and protecting the feed assembly from the weather. A primary feature of the invention is the versatile nature of the adjustable bracket mount and the feed horn bracket component of the adjustable bracket mount, which facilitate positioning of the feed horn and low noise amplifier at various distance from the center of a variety of selected antenna dishes in order to locate the feed assembly precisely at the prime focus of the antenna. Another important feature of the adjustable bracket mount of this invention is the stability of the bracket, which is designed to securely and positively, yet removably mount the feed horn and low noise amplifier with minimum vibration in a precise location with respect to the prime focus of the antenna. Still another important feature of the adjustable bracket mount is a dual design of the feed horn bracket, which is configured to receive feed horns of different design and to mount a cover shaped to protect the feed assembly from the elements.

2. Description of the Prior Art

Various mounting brackets and systems for securing the feed horn and low noise amplifier or feed assembly to the dish of a satellite antenna at the prime focus of the antenna are known in the art. Typical of these devices is the commonly used four-leg mount and the tripod mount, the latter of which is illustrated in FIG. 1 of applicant's drawing and is labeled "PRIOR ART". The tripod and four-leg mechanical supports suffer from the disadvantage of requiring three or four mounting points on the satellite dish, which points of attachment must be carefully chosen in order to ensure that the necessary feed assembly components of the antenna, which are secured to the apex of the pyramid formed by the three or four bracket legs, are located at the prime focus of the antenna. Furthermore, supports having legs of different lengths for each selected antenna dish of a different size are required, since the prime focus is different for satellite antennas of varying size and dish configuration.

Other mounting brackets and assemblies such as the single-leg mount, are also known in the art. The single-leg mount consists of a single rod or tube extending outwardly at an angle from the antenna dish to the prime focus, with the attitude angle chosen such that the feed assembly is mounted at the prime focus. Brackets of this design are difficult to mount securely such that the feed horn and low noise amplifier are free from undesirable vibration, which blurs the television image. A variation of the single-leg support or mount is the mount support which is offset by a double bend from a point of attachment to the dish, in order to locate the top of the bracket and the antenna feed assembly at the prime focus of the satellite antenna.

General purpose mounting brackets for such items as lamps, musical instruments, umbrellas and other devices are also known in the art. Typical of these mounts is the "Adjustable Lamp" disclosed in U.S. Pat. No. 1,511,630, dated Oct. 14, 1924, to M. Ozlek. The Ozlek "Adjustable Lamp" includes a central vertically-oriented lamp stand with a horizontal bracket member slidably positioned on the lamp stand and an auxiliary arm carried by the horizontal bracket member, with a lamp provided on one end of the auxiliary arm. Adjustment of the lamp in any direction is facilitated by operation of the bracket in cooperation with a mount knuckle carrying the extending auxiliary arm. A "Supporting Member" is disclosed in U.S. Pat. No. 1,149,762, dated Aug. 10, 1915, to F. F. Hendrickson. This device includes a vertically-oriented central support or rod and a block slidably engaging the rod, with a thumbscrew for securing the block to the rod at a selected height and a horizontally disposed rod extending through the block for carrying a musical instrument such as a cymbal. U.S. Pat. No. 462,265, dated Nov. 3, 1891, to B. F. Mason, discloses a "Vehicle Seat Attachment" which includes a vertically oriented arm having a longitudinal slot therein, a cooperating second arm also slotted and secured to the first arm by means of a bolt and wing nut, with a third slotted arm further secured to the second arm by means of a bolt and wing nut combination and designed to carry the handle of an umbrella. The multiple slot, wing nut and bolt combination facilitates adjustment of the umbrella in a variety of positions with respect to the base arm support member. A similar device styled "Universal Clamp" is disclosed in U.S. Pat. No. 551,358, dated Dec. 17, 1895, to A. O. Benecke. This invention discloses a vertically oriented rod support having a horizontal bracket attached thereto in slidable relationship with a second vertical support carrying a light bulb extending through the bracket. U.S. Pat. No. 4,142,190, dated Feb. 27, 1979, to John L. Kerr discloses a parabolic reflector which is fed by a microstrip antenna supported at the point of focus by a tube which is aligned along the focal axis of the reflector.

Accordingly, it is an object of this invention to provide a new and improved adjustable bracket mount for supporting the feed horn and low noise amplifier in a wide variety of satellite antennas, which bracket mount is stable, relatively free of vibration and is designed to locate the feed assembly components at the prime focus of these antennas and to protect the feed assembly components from the weather.

Another object of this invention is to provide an adjustable bracket mount for securely and positively, yet adjustably and removably supporting and protecting certain functional antenna components such as the feed assembly, at the prime focus or other desired location above the antenna dish in satellite antennas of various size and design.

Yet another object of the invention is to provide a new and improved adjustable bracket mount for mounting on the dish of a satellite antenna and securely, yet adjustably, supporting the antenna feed assembly at the prime focus of the antenna, which bracket mount is characterized by a base secured to the antenna dish, an offset bracket adjustably carried at one end by a bottom support slidably and rotatably mounted in the base, the offset bracket adjustably supporting a top support at the opposite end and a feed horn bracket having optional outwardly extending arms adjustably attached to the top support and designed to receive feed assembly components and precisely locate these components at the prime focus of the antenna, the feed horn bracket further adapted to receive and mount a cover for protecting the feed assembly components from the weather.

A still further object of the invention is to provide an adjustable bracket mount for locating an antenna feed assembly at the prime focus of a satellite antenna and protecting the feed assembly from the weather, which bracket mount includes a base secured to the antenna dish; a bottom support slidably and rotatably extending from the base toward the prime focus; a sloped offset bracket having one end rotatably and slidably carried by the bottom support, with the opposite end of the bracket rotatably and slidably attached to a top support, which top support is parallel to and offset above the bottom support; and a feed horn bracket having extending fingers and optional outwardly-extending finger extensions projecting from the fingers, with upward standing flanges for mounting and receiving a protective cover, the feed horn bracket rotatably and slidably carried by the top support and spaced from the offset bracket to facilitate positioning of the feed assembly at various prime focus locations in a wide variety of satellite antennas of various design and size.

Still another object of the invention is to provide an adjustable bracket mount for supporting the feed assembly in a satellite antenna, which bracket mount includes a feed horn bracket having mount apertures and extending fingers with optional projecting finger extensions for receiving feed horn assemblies of various design and for mounting a cover on the feed horn bracket to protect the feed horn.

SUMMARY OF THE INVENTION

These and other objects of the invention are provided in a new, improved and versatile adjustable bracket mount for supporting feed assembly components in a satellite antenna, which bracket mount includes a base secured to the antenna dish at a point near the center of the dish; a bottom tubular support projecting from the base in telescoping, adjustable relationship and secured in the base by means of an allen screw; a sloping and reversible off-set bracket having one end adjustably and telescopically secured to the bottom tubular support and located in a desired position on the bottom tubular support by a second allen screw; a top tubular support adjustably and telescopically positioned on the opposite end of the offset bracket and secured in a selected position on the offset bracket by a third allen screw; and a feed horn bracket having projecting fingers and optional outwardly-extending finger extensions with finger flanges for mounting a cover, the feed horn bracket adjustably and telescopically secured to the opposite end of the top tubular bracket and stabilized thereon by a fourth allen screw, to locate the antenna feed assembly at the desired prime focus and protect the feed assembly components from the elements.

BRIEF DESCRIPTION OF THE DRAWING

The invention will be better understood by reference to the accompanying drawing, wherein.

DESCRIPTION OF THE PREFERRED EMBODIMENTS

Figure 1:
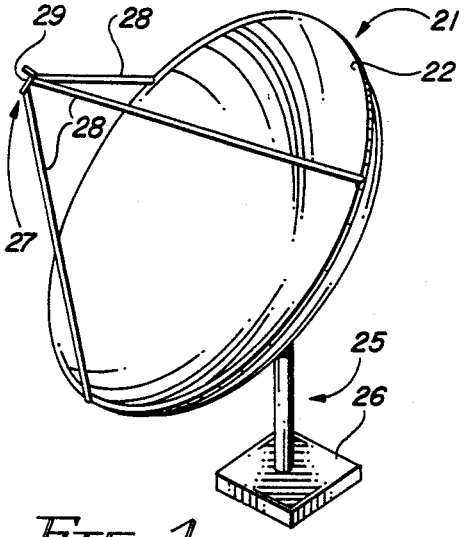
FIG. 1 (PRIOR ART)
FIG. 1 is a perspective view of a satellite antenna having a conventional tripod feed assembly mount secured to the antenna dish.

Referring now to FIG. 1 of the drawing a typical conventional satellite antenna 21 is illustrated, which includes an antenna dish 22, constructed of fiberglass, aluminum or other material known to those skilled in the art and supported by an antenna support 25, mounted on a suitable foundation 26. A conventional tripod mount 27 is characterized by three tripod legs 28, extending from attachment to a feed horn mount 29 to spaced points of attachment on the antenna dish 22, as illustrated. A feed horn and low noise amplifier (not illustrated) is designed to be secured to the feed horn mount 29 and the tripod legs 28 are sufficiently long and the tripod mount 27 so designed to locate the antenna feed assembly at the prime focus of the satellite antenna 21. It will be further appreciated that the antenna dish 22 of the satellite antenna 21 can be designed to pivot with respect to the antenna support 25, in order to aim the satellite antenna 21 at a satellite placed in geosynchronous orbit above the earth.

Figure 2:
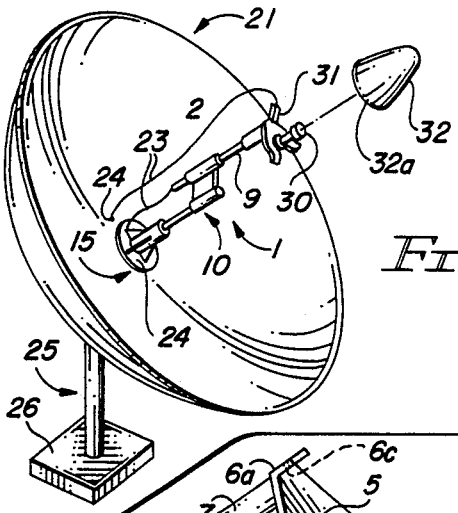
FIG. 2 is a perspective view of a satellite antenna having an adjustable bracket mount secured to the antenna dish and a first feed horn bracket for supporting the feed assembly, according to this invention.
Figure 3:
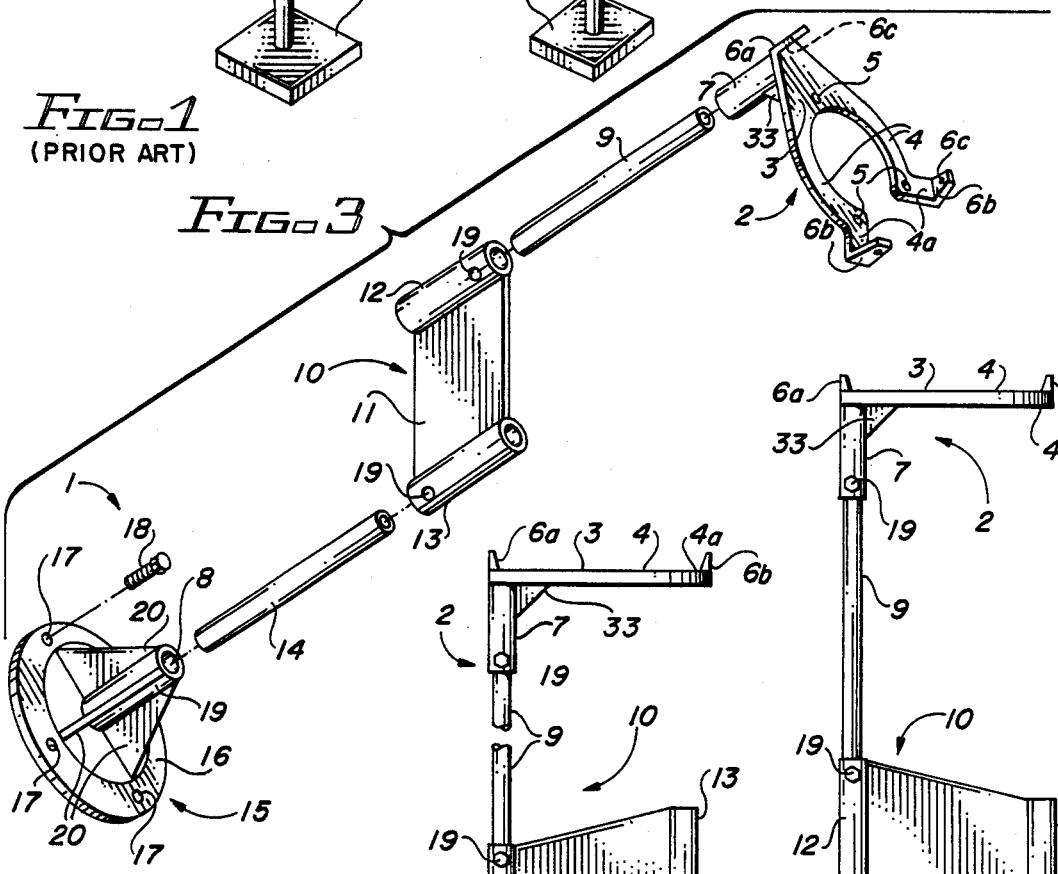
FIG. 3 is an exploded view of a preferred embodiment of the adjustable bracket mount of this invention, more particularly illustrating the first feed horn bracket illustrated in FIG. 2.
Figure 6:
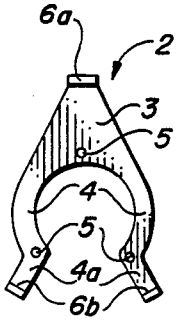
FIG. 6 is a top elevation of the first embodiment of the feed horn bracket illustrated in FIGS. 2 and 3.

Referring now to FIGS. 2, 3 and 6 of the drawing, in a preferred embodiment the adjustable bracket mount of this invention is generally illustrated by reference numeral 1 and is positioned on the antenna dish 22 of a conventional satellite antenna 21. The adjustable bracket mount 1 is characterized by a base 15, having a base flange 16 which is provided with base flange apertures 17, designed to receive mounting bolts 18 in order to secure the base 15 to the antenna dish 22. A tubular base receptacle 8 extends upwardly from the base flange 16 and is supported by spaced receptacle supports 20. A sloped offset bracket 10, which includes a bracket web 11 situated between a top support collar 12 and a bottom support collar 13, serves to space a round top support 9 above and parallel to a tubular bottom support 14, which bottom support 14 is selectively telescopically and rotatably mounted in the base receptacle 8 of the base 15. The bore of the top support collar 12 is slightly larger than the outside diameter of the top support 9, in order to facilitate slidable and rotatable telescoping of the top support 9 inside the top support collar 12. Similarly, the bore of the round bottom support collar 13 is slightly larger than the outside diameter of the tubular bottom support 14, in order to facilitate slidable and rotatable movement of the bottom support 14 with respect to the bottom support collar 13 and the offset bracket 10. The top support 9 can be stabilized inside the top support collar 12 and the bottom support 14 secured inside the bottom support collar 13 at selected locations by means of allen screws 19, which are threadibly inserted in the top support collar 12 and the bottom support collar 13, respectively, for purposes which will be hereinafter described. A feed horn bracket 2, having a first design characterized by a flat bracket plate 3 with curved plate fingers 4, having outwardly-extending finger extensions 4*a*, is secured in slidable and rotatably relationship to the top end of the top support 9 by means of a tubular top bracket collar or plate neck 7, which threadibly carries an allen screw 19. A support web 33 serves to brace the bracket plate 3 on the plate neck 7. A plate flange 6*a* projects upwardly from the apex of the bracket plate 3 above the plate neck 7 and finger flanges 6*b* extend upwardly in perpendicular, spaced relationship from the ends of the finger extensions 4*a*, and parallel to the plate flange 6*a*. The plate flange 6*a* and finger flanges 6*b* are further provided with flange apertures 6*c*, as illustrated in FIG. 3, for securing a cone-shaped cover 32 on the feed horn bracket 2 by means of suitable fasteners (not illustrated). Mount apertures 5, spaced in the bracket plate 3 and bracket fingers 4, serve to accomodate mounting bolts (not illustrated) in order to mount a conventional feed horn 30 to the bracket plate 3 and bracket fingers 4. As illustrated in FIG. 2 a low noise amplifier 31 is attached to the feed horn 30 in conventional fashion and conventional wiring 23 extends from the feed horn 30 and the low noise amplifier 31 through the wiring aperture 24 in the antenna dish 22, in order to transmit a signal received by the satellite antenna 21 to supplemental electronic equipment which facilitates an image on a television set.

Figure 4:
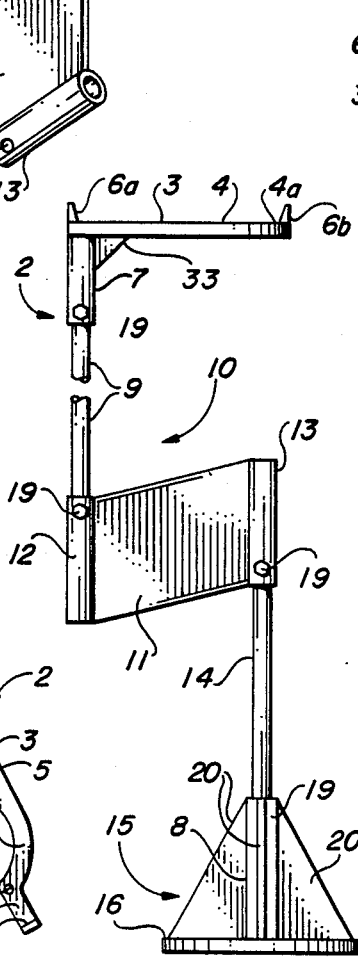
FIG. 4 is a side elevation of the bracket mount illustrated in FIG. 3.

Referring now to FIGS. 2, 3 and 4 of the drawing, it will be appreciated that the adjustable bracket mount 1 of this invention is capable of adjustment to locate the feed horn 30 and low noise amplifier 31 at many desired positions above a selected antenna dish 22 and the antenna feed assembly components at the prime focus of substantially any satellite antenna 21. This adjustment is accomplished by loosening one or more of the allen screws 19 located in the top support collar 12, the bottom support collar 13, the base receptacle 8 and the plate neck 7. The feed horn bracket 2 can then be slidably positioned on the top support 9, the top support 9 slidably manipulated in the top support collar 12, the bottom support collar 13 slidably adjusted on the bottom support 14 and the bottom support 14 adjusted in the base receptacle 8. In this manner, a desired height of the feed horn 30 and low noise amplifier 31 above the center of the antenna dish 22 can be easily set by tightening the respective allen screws 19. Furthermore, if the center of the antenna dish 22 is assumed to be at or near the wiring aperture 24 as illustrated in FIG. 2, the feed horn 30 can be manipulated to the most desirable position directly over the wiring aperture 24 by rotational adjustment of the feed horn bracket 2 with respect to the top support 9 and/or additional rotational adjustment of the offset bracket 10 with respect to the base 15, by manipulating the allen screws 19 as described above. Accordingly, it will be appreciated by those skilled in the art that in the event the adjustable bracket mount 1 is used in cooperation with a satellite antenna 21 having a larger antenna dish than the antenna dish 22 illustrated in FIG. 2, then the appropriate adjustments can be made as heretofore described, in order to extend the height of the feed horn 30 and the low noise amplifier 31 to the new prime focus location of the larger satellite antenna.

Figure 5:
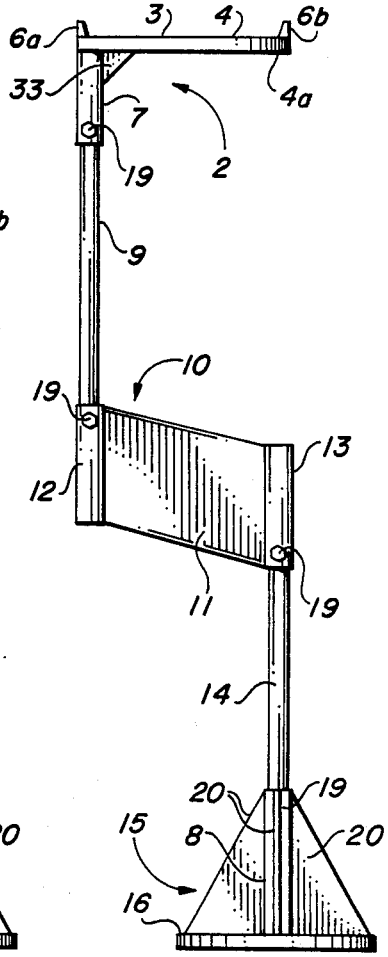
FIG. 5 is a side elevation of the bracket mount illustrated in FIG. 4, with the offset bracket reversed.

Referring now to FIGS. 4 and 5 of the drawing, under circumstances where additional height is desired in the adjustable bracket mount 1 in order to locate the feed horn 30 and low noise amplifier 31 at a specific height in a satellite antenna 21 shown in FIG. 2, the offset bracket 10 can be reversed from the position illustrated in FIG. 4, such that the top support collar 12 is in the top position and the bottom support collar 13 is in the bottom position, as illustrated in FIG. 5. This configuration facilitates additional height above the antenna dish 22 without the necessity of using a different adjustable bracket mount 1. The height of the feed horn bracket 2 above the antenna dish 22 can also be increased by securing the top support collar 12 of the offset bracket 10 to the extreme bottom portion of the top support 9, extending the bottom support 14 to a maximum height in the base receptacle 8 of the base 15, sliding the top segment of the bottom support 14 downwardly as far as possible in the bottom support collar 13 and extending the plate neck 7 upwardly to maximum extension on the top segment of the top support 9. In this manner, the height of the feed horn bracket 2 can be adjusted to accord with a wide range of prime focus locations on satellite antennas of various design and size.

Figure 7:
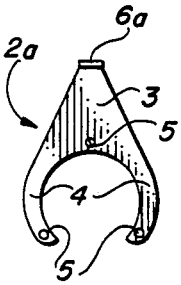
FIG. 7 is a top elevation of a second embodiment of the feed horn bracket in the adjustable bracket mount of this invention.

Referring now to FIG. 7 of the drawing a modified feed horn bracket 2*a* is illustrated, and is shaped generally in the configuration of the feed horn bracket 2 illustrated in FIGS. 2, 3 and 6. However, the finger extensions 4*a* are not present in the modified feed horn bracket 2*a*, in order to accomodate a feed horn (not illustrated) of different design. The feed horn which is supported by the modified feed horn bracket 4*a* is designed to fit on the bracket plate 3 and plate fingers 4 and suitable fasteners (not illustrated) are provided to engage the feed horn and threadably engage the mount apertures 5, in order to secure the feed horn to the modified feed horn bracket 2*a*. The corresponding feed horn of compatible design carries a bracket which is capable of being oriented in spaced, parallel relationship with respect to the plate flange 6*a*, in order to secure the cover 32 to the plate flange 6*a* and the feed horn bracket by means of the flange aperture 6*c*, provided in the plate flange 6*a* and a corresponding aperture (not illustrated) in the feed horn bracket.

It will be appreciated from a consideration of FIGS. 1, 3, 4, 6 and 7 that the cover base 32*a* of the cover 32 is normally fitted on the inside of the spaced plate flange 6*a* and finger flanges 6*b*, and rests on the bracket plate 3 and the finger extensions 4*a* of the feed horn bracket 2, when located in functional position on the feed horn bracket 2. Fasteners of suitable design (not illustrated) are then extended through the flange apertures 6*c* and corresponding openings (not illustrated) provided in the cover base 32*a* to removably secure the cover 32 on the feed horn bracket 2. However, in a preferred embodiment of the invention where the modified feed horn bracket 2*a* is used to mount a corresponding feed horn having a cooperating bracket for mounting the cover 32, the cover base 32*a* of the cover 32 is fitted over and outside of the corresponding feed horn bracket and plate flange 6a. Suitable fasteners are then projected through openings in the cover base 32a and through the registering openings or flange apertures 6c, to secure the cover 32 on the modified feed horn bracket 2a.

It will be appreciated by those skilled in the art that the adjustable bracket mount 1 of this invention can be used in association with substantially any satellite antenna of the dish design, wherein one or more functional components of the antenna must be suspended securely above a selected antenna dish at a specified prime focus. Accordingly, whether the antenna is designed to transmit an uplink signal or to receive a downlink signal, the adjustable bracket mount 1 can be secured to the antenna dish and adjusted as described herein, to precisely and securely locate the suspended transmitting or receiving components in the prescribed location.

It will be further appreciated that other fastening means such as threaded bolts and the like, can be used in place of the allen screws 19 to selectively secure the respective components of the adjustable bracket mount 1 in rigid configuration, according to the knowledge of those skilled in the art. Accordingly, while the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. In a satellite antenna having an antenna dish and a feed assembly, an adjustable bracket mount for supporting the feed assembly above the antenna dish comprising:

(a) a base for mounting on the antenna dish (b) a bottom support provided in telescoping cooperation with said base;

(c) an offset bracket having a bottom support collar provided in telescoping cooperation with said bottom support above said base, with the center transverse axis of said bottom support collar oriented in a first plane; a top support collar spaced from said bottom support collar, with the center transverse axis of said top support collar oriented in a second plane, said second plane being parallel to said first plane; and a sloping, flat web spanning said bottom support collar and said top support collar;

(d) a top support provided in telescoping cooperation with said top support collar; and (e) a top bracket having a top bracket collar provided in telescoping cooperation with said top support, said top bracket characterized by a bracket plate carried by said top bracket collar and a pair of inwardly curving bracket fingers projecting from said bracket plate for supporting the feed assembly.

2. The adjustable bracket mount of claim 1 further comprising first engaging means provided in cooperation with said base and said bottom support, whereby slidable and rotatable movement of said bottom support with respect to said base is selectively prevented; second engaging means provided in cooperation with said bottom support collar of said offset bracket and said bottom support, whereby slidable and rotatable movement of said bottom support collar with respect to said bottom support is selectively prevented; third engaging means provided in cooperation with said top support collar of said offset bracket and said top support, whereby slidable and rotatable movement of said top support with respect to said top support collar is selectively prevented, and fourth engaging means provided in cooperation with said top bracket and said top support, whereby slidable and rotatable movement of said top bracket with respect to said top support is selectively prevented.

3. The adjustable bracket mount of claim 1 wherein said first plane is located above said second plane.

4. The adjustable bracket mount of claim 1 wherein said first plane is located below said second plane.

5. The adjustable bracket mount of claim 1 wherein said first plane is located above said second plane and further comprising first engaging means provided in cooperation with said base and said bottom support, whereby slidable and rotatable movement of said bottom support with respect to said base is selectively prevented; second engaging means provided in cooperation with said bottom support collar of said offset bracket and said bottom support, whereby slidable and rotatable movement of said bottom support collar with respect to said bottom support is selectively prevented; third engaging means provided in cooperation with said top support collar of said offset bracket and said top support, whereby slidable and rotatable movement of said top support with respect to said top support collar is selectively prevented, and fourth engaging means provided in cooperation with said top bracket and said top support, whereby slidable and rotatable movement of said top bracket with respect to said top support is selectively prevented.

6. The adjustable bracket mount of claim 1 wherein said first plane is located below said second plane and further comprising first engaging means provided in cooperation with said base and said bottom support, whereby slidable and rotatable movement of said bottom support with respect to said base is selectively prevented; second engaging means provided in cooperation with said bottom support collar of said offset bracket and said bottom support, whereby slidable and rotatable movement of said bottom support collar with respect to said bottom support is selectively prevented; third engaging means provided in cooperation with said top support collar of said offset bracket and said top support, whereby slidable and rotatable movement of said top support with respect to said top support collar is selectively prevented, and fourth engaging means provided in cooperation with said top bracket and said top support, whereby slidable and rotatable movement of said top bracket with respect to said top support is selectively prevented.

7. The adjustable bracket of claim 1 further comprising a cover adapted for mounting on said top bracket for covering the feed assembly when the feed assembly is mounted on said top bracket.

8. The adjustable bracket of claim 7 further comprising a plate flange projecting from said bracket plate for receiving said cover and a flange aperture extending through said plate flange for securing said cover to said top bracket.

9. The adjustable bracket of claim 1 further comprising:

(a) first engaging means provided in cooperation with said base and said bottom support, whereby slidable and rotatable movement of said bottom support with respect to said base is selectively prevented; second engaging means provided in cooperation with said bottom support collar of said offset bracket and said bottom support, whereby slidable and rotatable movement of said bottom support collar with respect to said bottom support is selectively prevented; third engaging means provided in cooperation with said top support collar of said offset bracket and said top support, whereby slidable and rotatable movement of said top support with respect to said top support collar is selectively prevented, and fourth engaging means provided in cooperation with said top bracket and said top support, whereby slidable and rotatable movement of said top bracket with respect to said top support is prevented;

(b) a cover adapted for mounting on said bracket for covering the feed assembly when the feed assembly is mounted on said top bracket; and (c) a plate flange projecting from said bracket plate for receiving said cover and a flange aperture extending through said plate flange for securing said cover to said top bracket.

10. The adjustable bracket of claim 9 wherein said first plane is located above said second plane.

11. The adjustable bracket of claim 9 wherein said first plane is located below said second plane.

12. The adjustable bracket of claim 9 wherein said first engaging means, said second engaging means, said third engaging means and said fourth engaging means are allen screws, respectively.

13. The adjustable bracket of claim 9 wherein said bottom support, said bottom support collar, said top support collar, said top support and said top bracket collar are each characterized by a round cross-sectional configuration.

14. The adjustable bracket of claim 9 wherein:

(a) said first engaging means, said second engaging means, said third engaging means and said fourth engaging means are allen screws, respectively; and (b) said bottom support collar, said top support collar, said top support and said top bracket collar are each characterized by a round cross-sectional configuration.

15. The adjustable bracket of claim 14 wherein said first plane is located above said second plane.

16. The adjustable bracket of claim 14 wherein said first plane is located below said second plane.

17. The adjustable bracket of claim 9 further comprising mount apertures provided in spaced relationship in said bracket plate and said plate fingers for securing the feed assembly to said top bracket.

18. The adjustable bracket of claim 9 wherein;

(a) said first engaging means, said second engaging means, said third engaging means and said fourth engaging means are allen screws, respectively;

(b) said bottom support collar, said top support collar, said top support and said top bracket collar are each characterized by a round cross-sectional configuration; and further comprising mount apertures provided in said bracket plate and said plate fingers in spaced relationship for securing the feed assembly to said top bracket.

19. The adjustable bracket mount of claim 7 further comprising:

(a) a plate flange projecting from said bracket plate for receiving said cover and a plate flange aperture extending through said plate flange for securing said cover to said top bracket; and (b) finger extensions projecting in outwardly angular relationship from the extending ends of said plate fingers and finger flanges projecting from said finger extensions in spaced relationship with respect to each other and in spaced, generally parallel relationship with respect to said plate flange, with finger flange apertures extending through said finger flanges for stabilizing said cover.

20. The adjustable bracket of claim 19 further comprising first engaging means provided in cooperation with said base and said bottom support, whereby slidable and rotatable movement of said bottom support with respect to said base is selectively prevented; second engaging means provided in cooperation with said bottom support collar of said offset bracket and said bottom support, whereby slidable and rotatable movement of said bottom support collar with respect to said bottom support is selectively prevented; third engaging means provided in cooperation with said top support collar of said offset bracket and said top support, whereby slidable and rotatable movement of said top support with respect to said top support collar is selectively prevented, and fourth engaging means provided in cooperation with said top bracket and said top support, whereby slidable and rotatable movement of said top bracket with respect to said top support is selectively prevented.

21. The adjustable bracket of claim 20 wherein:

(a) said first engaging means, said second engaging means, said third engaging means and said fourth engaging means are allen screws, respectively; and (b) said bottom support, said bottom support collar, said top support collar, said top support and said top bracket collar are each characterized by a round cross-sectional configuration.

22. The adjustable bracket of claim 21 further comprising mount apertures provided in spaced relationship in said bracket plate and said plate fingers for securing the feed assembly to said top bracket.

23. The adjustable bracket of claim 22 wherein said first plane is located above said second plane.

24. The adjustable bracket of claim 22 wherein said first plane is located below said second plane.

25. In a satellite antenna having an antenna dish and a feed assembly, an adjustable bracket mount for supporting the feed assembly above the antenna dish comprising:

(a) a base for mounting on the antenna dish and a base receptacle extending from said base;

(b) a bottom support provided in telescoping cooperation with said base receptacle;

(c) an offset bracket having a bottom support collar provided in telescoping cooperation with said bottom support above said base, with the center transverse axis of said bottom support collar oriented in a first plane; a top support collar spaced from said bottom support collar, with the center transverse axis of said top support collar oriented in a second plane, said second plane being parallel to said first plane; and a sloping, flat web spanning said bottom support collar and said top support collar;

(d) a top support provided in telescoping cooperation with said top support collar; and (e) a top bracket having a top bracket collar provided in telescoping cooperation with said top support, said top bracket characterized by a bracket plate carried by said top bracket collar and a pair of inwardly curving bracket fingers projecting from said bracket plate for supporting the feed assembly and further comprising finger extensions projecting in outwardly angular relationship from the extending ends of said bracket fingers, said finger extensions disposed in spaced relationship with respect to each other; and (f) a cover adapted for mounting on said bracket plate and said finger extensions for covering the feed assembly when the feed assembly is mounted on the top bracket.

26. The adjustable bracket mount of claim 25 further comprising a plate flange projecting from said bracket plate, with a flange aperture extending through said plate flange and finger flanges projecting from said finger extensions in spaced relationship with respect to each other and in spaced, generally parallel relationship with respect to said plate flange, with finger flange apertures extending through said finger flanges, for stabilizing said cover on said top bracket.

27. The adjustable bracket mount of claim 26 further comprising first engaging means provided in cooperation with said base receptacle and said bottom support, whereby slidable and rotatable movement of said bottom support with respect to said base is selectively prevented; second engaging means provided in cooperation with said bottom support collar of said offset bracket and said bottom support, whereby slidable and rotatable movement of said bottom support collar with respect to said bottom support is selectively prevented; third engaging means provided in cooperation with said top support collar of said offset bracket and said top support, whereby slidable and rotatable movement of said top support with respect to said top support collar is selectively prevented, and fourth engaging means provided in cooperation with said top bracket and said top support, whereby slidable and rotatable movement of said top bracket with respect to said top support is selectively prevented.

28. The adjustable bracket of claim 27 wherein said first engaging means, said second engaging means, said third engaging means and said fourth engaging means are allen screws, respectively.

29. The adjustable bracket mount of claim 28 wherein said base receptacle, said bottom support, said bottom support collar, said top support collar, said top support and said top bracket collar are each characterized by a round cross-sectional configuration.

30. The adjustable bracket mount of claim 29 further comprising mount apertures provided in spaced relationship in said bracket plate and said plate fingers for securing the feed assembly to said top bracket.

31. The adjustable bracket mount of claim 30 wherein said first plane is located above said second plane.

32. The adjustable bracket mount of claim 30 wherein said first plane is located below said second plane.

* * * * *